US011788347B2

(12) United States Patent
Zimmermann et al.

(10) Patent No.: US 11,788,347 B2
(45) Date of Patent: Oct. 17, 2023

(54) GUIDE RAIL DEVICE FOR A ROLLING DOOR OR ROLLING GRILLE

(71) Applicant: Hörmann KG Dissen, Dissen (DE)

(72) Inventors: Bastian Zimmermann, Spenge (DE); Thomas Langkamp, Georgsmarienhütte (DE)

(73) Assignee: Hörmann KG Dissen, Dissen (DE)

( * ) Notice: Subject to any disclaimer, the term of this patent is extended or adjusted under 35 U.S.C. 154(b) by 57 days.

(21) Appl. No.: 17/126,912

(22) Filed: Dec. 18, 2020

(65) Prior Publication Data

US 2022/0195796 A1 Jun. 23, 2022

(51) Int. Cl.
*E06B 9/58* (2006.01)
*F41H 5/22* (2006.01)

(52) U.S. Cl.
CPC ..... *E06B 9/58* (2013.01); *F41H 5/226* (2013.01); *E06B 2009/587* (2013.01)

(58) Field of Classification Search
CPC ..... E06B 9/58; E06B 2009/587; E06B 9/581; E06B 9/15; E06B 9/17; E06B 9/17061; E06B 2009/1577; E06B 2009/585
See application file for complete search history.

(56) References Cited

U.S. PATENT DOCUMENTS 5,460,216 A * 10/1995 Hirao ..... E06B 9/17 160/133
7,389,807 B2 * 6/2008 Nagare ..... E06B 9/13 160/273.1
7,726,377 B2 * 6/2010 Okachi ..... E06B 9/262 160/84.06
9,416,589 B2 * 8/2016 McTavish ..... E06B 9/58
9,915,094 B2 * 3/2018 Frede ..... E06B 9/60
(Continued)

FOREIGN PATENT DOCUMENTS

DE 9403967 U1 8/1994
EP 1882806 A1 1/2008
FR 2565285 A2 12/1985

OTHER PUBLICATIONS

Types of Resins and Their Uses, https://www.thomasnet.com/articles/plastics-rubber/types-of-resins/ (Year: 2022).*
(Continued)

*Primary Examiner* — Abe Massad
*Assistant Examiner* — John W Hanes, Jr.
(74) *Attorney, Agent, or Firm* — United One Law Group LLC; Kongsik Kim; Jhongwoo Peck

(57) ABSTRACT

A guide rail device for laterally guiding a rolling door or rolling grille armor of a rolling door or rolling grille includes a guide rail for vertically guiding the rolling door or rolling grille armor, an infeed funnel for guiding the rolling door or rolling grille armor into an entry area of the guide rail, with the infeed funnel being movable relative to the guide rail, and a damping body connected to the infeed funnel which dampens vibrations and shocks of the infeed funnel. Further, a rolling door or rolling grille includes a first guide rail device and a second guide rail device. In particular, the guide rail of the first guide rail device is fixed laterally on the building opening, and the guide rail of the second guide rail device is fixed laterally on the opposite side of the building opening.

10 Claims, 4 Drawing Sheets

(56) References Cited

U.S. PATENT DOCUMENTS

| | | | | |
|---|---|---|---|---|
| 11,142,946 | B2 * | 10/2021 | McNabb | E06B 9/582 |
| 2016/0076301 | A1 * | 3/2016 | Langkamp | E05D 15/24 160/133 |
| 2018/0313082 | A1 * | 11/2018 | Klein | B32B 3/08 |
| 2019/0048658 | A1 * | 2/2019 | Garcia Hernandez | E06B 9/581 |

OTHER PUBLICATIONS

All About Silicone Resins, https://www.thomasnet.com/articles/plastics-rubber/all-about-silicone-resins/ (Year: 2022).*

* cited by examiner

GUIDE RAIL DEVICE FOR A ROLLING DOOR OR ROLLING GRILLE

TECHNICAL FIELD

The invention relates to a guide rail device for laterally guiding a rolling door or rolling grille armor of a rolling door or rolling grille.

BACKGROUND

Rolling doors have a rolling door curtain or a rolling door armor as a door leaf, which is made up of several hinged slats and which can be wound onto a winding shaft to open the rolling door and unwound from the winding shaft to close the rolling door. Such rolling doors open vertically and hardly need space. Due to their design principles, they provide maximum space in and in front of the building lockable with the rolling door.

Fields of application, structure and assembly information concerning rolling doors and rolling grilles as well as their design can be found, for example, in the company publication:

[1] "Rolltore and Rollgitter"; Stand 10.2018/Druck 10.2018/HF 84555 DE/PDF of Hörmann KG Verkaufsgesellschaft.

SUMMARY

It is an object of the present invention to reduce the noise produced during the opening and closing of rolling doors and rolling grilles and the wear on components of rolling doors and rolling grilles and to extend their service life.

To solve this problem, the invention provides a guide rail device for laterally guiding a rolling door or rolling grille armor of a rolling door or rolling grille according to claim 1.

Advantageous designs are the subject of the subclaims.

According to one aspect, the invention provides a guide rail device for laterally guiding a rolling door or rolling grille armor of a rolling door or rolling grille, comprising a guide rail for laterally guiding the rolling door or rolling grille, and an infeed funnel for guiding the rolling door or rolling grille armor into an entry area of the guide rail, which infeed funnel is movable relative to the guide rail, and comprising a damping body connected to the infeed funnel to dampen vibrations and shocks of the infeed funnel.

One embodiment of a rolling door comprises a rolling door armor with slats that are hinged together. However, the guide rail device is also suitable for guiding a rolling grille having grille slats of a rolling grille armor which are hinged together.

On both sides of the rolling door or rolling grille armor, guide rails, in particular vertical guide rails, are attached to the sides of the building opening to be closed with the rolling door/rolling grille for laterally guiding the slats.

During opening or closing of the rolling door/rolling grille, the slats of the rolling door or rolling grille armor are wound onto or unwound from a winding shaft arranged in the upper region of the building opening.

When the rolling door or rolling grille armor is wound onto or unwound from the winding shaft of the rolling door/rolling grille, the bale diameter of the rolling door or rolling grille armor wound onto the winding shaft changes.

Therefore, for guiding the rolling door or rolling grille armor into the entry area of the guide rail, an infeed funnel as generally known is provided which is fixed to the guide rail to guide the rolling door or rolling grille armor into the vertically running guide rail.

One idea of the invention is now to decouple the infeed funnel from the guide rail so that the infeed funnel is movable relative to the guide rail.

Further, a damping body is provided at the infeed funnel to dampen vibrations and shocks of the infeed funnel.

The feed angle of the rolling door or rolling grille armor relative to the guide rail can vary during winding or unwinding the rolling door or rolling grille armor onto or from the winding shaft, because the bale diameter of the rolling door or rolling grille armor on the winding shaft can change.

The mobility of the infeed funnel enables the infeed funnel to adjust to the feed angle of the rolling door or rolling grille armor relative to the guide rail.

This reduces wear on the rolling door or rolling grille armor and/or the infeed funnel. Also noise production is reduced.

To further reduce noise production, a damping body is preferably arranged on the infeed funnel which dampens vibrations and shocks of the infeed funnel.

It is preferred that the guide rail and the infeed funnel are connected to each other via a joint.

It is preferred to connect the guide rail and the infeed funnel to each other via a joint. The joint enables the infeed funnel to move relative to the guide rail.

It is preferred that the damping body is designed as an elastic connecting element connecting the guide rail and the infeed funnel to each other and that the guide rail and the infeed funnel are engaged to each other via said connecting element.

One embodiment of the invention is that the damping body is disposed between the guide rail and the infeed funnel and connects the guide rail and the infeed funnel to one another.

This connecting element can be elastically designed so that both movement of the infeed funnel relative to the guide rail and damping of vibrations and shocks of the infeed funnel can be achieved due to the elasticity of the connecting element.

It is preferred that the connecting element is fixed to the guide rail and/or infeed funnel via screw connections.

It is preferred that the connecting element can be plug-fitted on or in the guide rail and/or infeed funnel.

It is preferred that the damping body is made from an elastomer.

It is preferred that the guide rail is in the form of an elongated U having two opposite rail legs which are connected via a web and that a rail leg sliding profile is provided on the inner sides of each rail leg for the rolling door or rolling grille armor to slide along with low friction.

The rolling door or rolling grille armor is guided between the opposite rail legs of the guide rail.

To allow the rolling door or rolling grille armor to slide along with low friction, rail leg sliding profiles, for example made of plastic, are provided on the inner sides of the rail legs facing the rolling door or rolling grille armor.

It is preferred that the infeed funnel comprises two opposite funnel elements which are inclined and/or curved towards the outside of the rail legs of the guide rail.

The infeed funnel preferably comprises two opposite funnel elements.

Preferably, the funnel elements are inclined and/or curved towards the outside of the rail legs of the guide rail. The funnel elements thus form an entry area of the infeed funnel which is open at an angle. This enables the rolling door or rolling grille armor, which can be wound onto or unwound from the winding shaft, to enter into the infeed funnel under different feed angles.

The funnel elements can be made of metal, plastic, or an elastomer, for example, or combinations thereof.

For example, the rubber funnel elements can be designed to be flexible. This allows the funnel elements to be movable relative to the guide rail, and the movement of the funnel elements is dampened.

The funnel shape of these funnel elements serves to guide the rolling door or rolling grille armor. The dynamic adjustment of the movably supported and/or flexibly designed infeed funnel significantly improves this effect by better distributing the forces that occur, thus making the rolling door or rolling grille run more smoothly and reducing the rolling door or rolling grille load.

It is preferred that the funnel elements each have a funnel element sliding profile for low-friction sliding of the rolling door or rolling grille armor and/or that the funnel elements are connected to one another via a profile in the form of an elongated U.

In one possible embodiment, the infeed funnel has a cross-section similar to the guide rail in the form of an elongated U. For example, the funnel elements can be attached to the profile of the infeed funnel.

For low-friction sliding of the rolling door or rolling grille armor in the infeed funnel, funnel element slide profiles can be attached to the inner sides of the two opposite funnel elements.

It is preferred that the connecting element is in the form of an elongated U having a web, two opposite legs and an opening for the passage of the rolling door or rolling grille armor.

Accordingly, it is preferable that the guide rail, the connecting element and the infeed funnel be designed with profiles in the form of an elongated U. The rolling door or rolling grille armor can be guided through the opening and laterally along the legs of the profiles.

It is preferred that the rail leg sliding profiles and/or the funnel element sliding profiles project beyond the guide rail or the infeed funnel, and the projecting area of the rail leg sliding profiles or funnel element sliding profiles is arranged on the inside of the legs of the connecting element so that the rolling door or rolling grille armor can slide along the rail leg sliding profiles and/or the funnel element sliding profiles when passing through the opening of the connecting element.

Extended funnel element sliding profiles and/or rail leg sliding profiles also enable low-friction passage of the rolling door or rolling grille armor through the connecting element.

According to another aspect, the invention provides a rolling door or rolling grille having a first guide rail device and a second guide rail device, wherein the guide rail of the first guide rail device is laterally attached to the building opening to be closed with the rolling door or rolling grille and the guide rail of the second guide rail device is laterally attached to the opposite side of the building opening to be closed with the rolling door/rolling grille.

In other words, the invention provides a rolling door/rolling grille with flexible funnels.

Another idea of the invention is to decouple the infeed funnel of a guide rail device for rolling doors/rolling grilles both mechanically and acoustically.

One objective of the invention is to separate the guide rail and the infeed funnel in terms of their mobility and sound transmission in order to reduce the operating noise or noise emission, reduce wear and thus extend the service life of a rolling door or rolling grille.

In implementation, the invention comprises both articulated mounting and decoupling, such as via individual joints and rubber mounts.

The impact of the individual slats of the rolling door or rolling grille profiles on the infeed funnel generates forces and thus noise and wear in the case of a rigid infeed funnel.

The operating principle of the flexible funnel is based on the fact that the flexible infeed funnel converts a share of this energy released by the forces into movement, thus reducing noise and wear on the door or grille curtain and on the funnel or the sliding profiles of the infeed funnel.

BRIEF DESCRIPTION OF THE DRAWINGS

One exemplary embodiment is described in more detail below with reference to the accompanying drawings. It is shown by.

DETAILED DESCRIPTION

In the following, one embodiment of the invention is described with reference to rolling doors. Nevertheless, it is understood that the invention is also applicable to rolling grilles.

Figure 1:
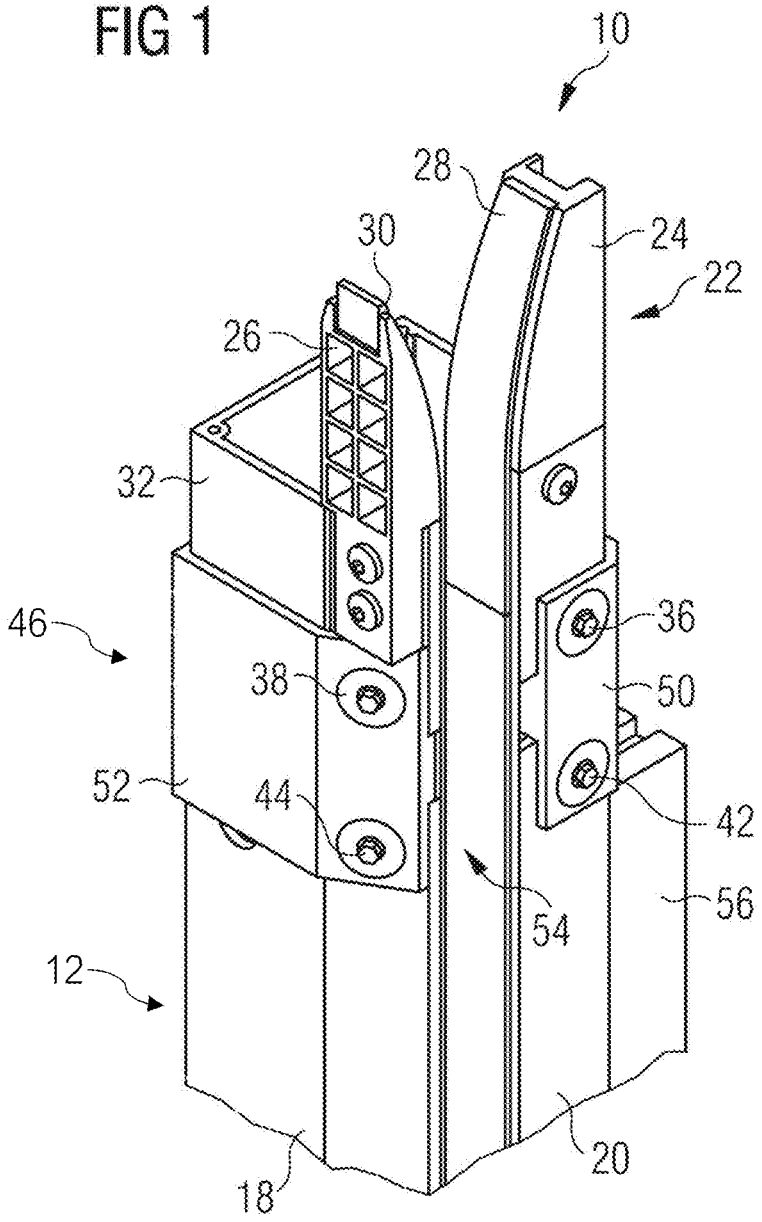
FIG. 1 a representation of a guide rail device for a rolling door according to one embodiment of the invention.

FIG. 1 shows a representation of a guide rail device 10 for a rolling door 11 according to one embodiment of the invention.

The guide rail device 10 has a guide rail 12 in the lower region of the illustration. The guide rail 12 has a profile which is U-shaped in cross section and which is elongated. The profile of the guide rail 12 has a web 16 and two opposing rail legs 18, 20.

In the upper area of the illustration of FIG. 1, an infeed funnel 22 is shown.

The infeed funnel 22 has two opposing funnel elements 24, 26. As can be seen from FIG. 1, the inner surfaces 28, 30 of the funnel elements 24, 26 are each curved in a skid-like manner in the direction of the outer side of the rail legs 18, 20.

The infeed funnel 22 further has a profile 32 which is also U-shaped in cross-section.

The U-shaped profile 32 is in particular rigid, i.e. not elastic.

In the embodiment shown, the funnel elements 24, 26 are attached to the profile 32 of the infeed funnel 22 by screws. Alternatively or additionally, the funnel elements 24, 26 can also be attached to the profile 32 of the infeed funnel 22 in another way, for example by being plugged on the profile.

The funnel elements 24, 26 can be made of metal or plastic, for example.

Due to the fixed connection between the U-shaped profile 32 and the funnel elements 24, 26, these are designed as rigid, inelastic and fixedly interconnected components of the infeed funnel 22.

The infeed funnel 22 is connected to a damping body 46. In the exemplary embodiment, the infeed funnel 22 is attached to the damping body 46 by screws 36, 38.

The damping body 46 can also have a profile with a U-shaped cross-section, although other designs of the damping body 46 are also conceivable.

Preferably, the damping body 46 is made of an elastomer.

In the embodiment of the guide rail device 10 shown in FIG. 1, the damping body 46 is also connected to the guide rail 12 via screw connections 42, 44.

The infeed funnel 22 can thus be connected to the guide rail via the damping body 46, constituting a joint. The joint can, for example, be designed as a swivel joint, whereby the infeed funnel 22 can be rotated about an axis of rotation.

In the embodiment shown, the damping body 46 connects the guide rail 12 and the infeed funnel 22 to each other. The damping body 46 therefore constitutes a connecting element. Hereinbelow, to describe this embodiment, the terms damping body 46 and the connecting element are used interchangeably.

The damping body 46 has a web 48, two opposite legs 50, 52 and an opening 54.

Other constructions are conceivable. For example, instead of being attached to the guide rail 12, the damping body 46 can also be attached to masonry or the like in such a way that there is no connection between the guide rail 12 and the infeed funnel 22.

Furthermore, a relining tube 56 may be attached to one side of the guide rail 12.

Figure 2:
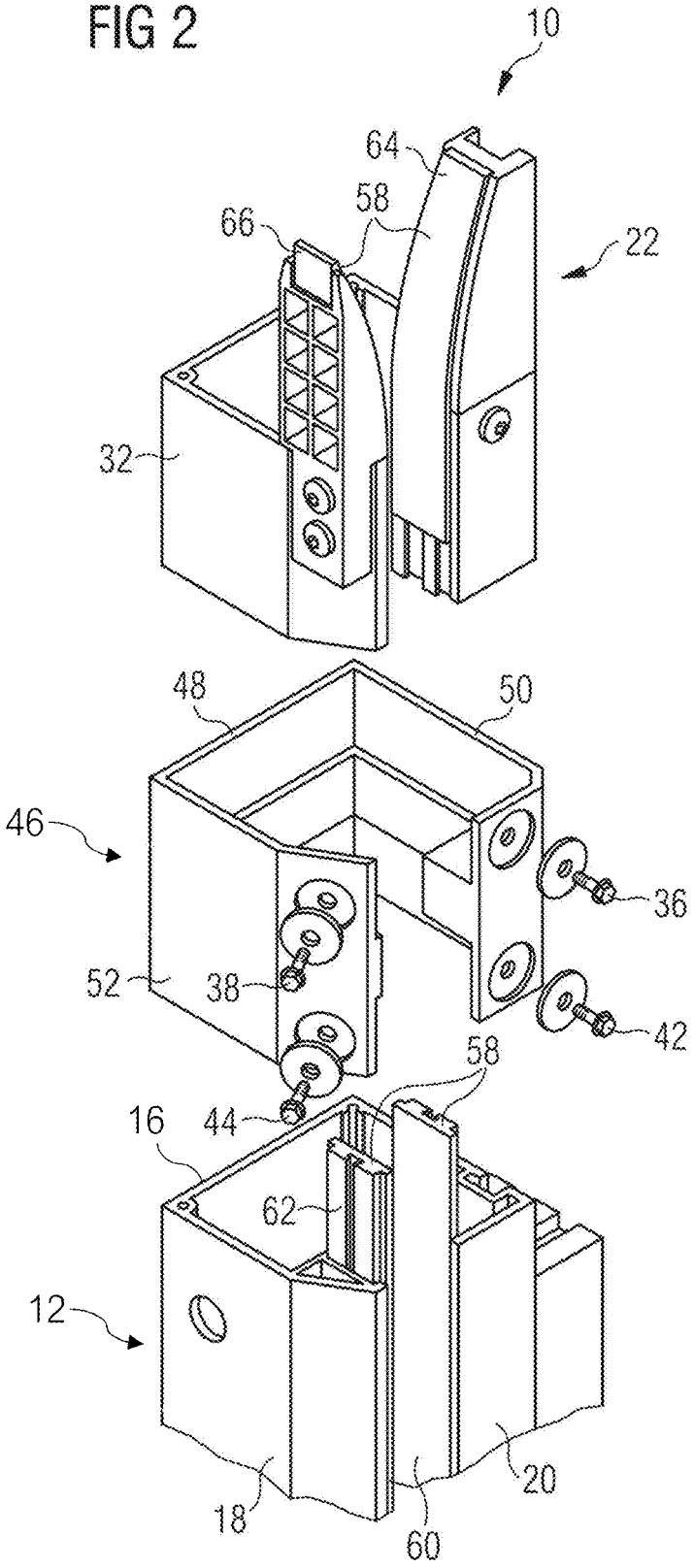
FIG. 2 an exploded view of the guide rail device of FIG. 1.

FIG. 2 shows an exploded view of the guide rail device 10 of FIG. 1.

As can be seen therefrom, the U-shaped profile of the damping body 46 or the connecting element is slid over the U-shaped profile of the guide rail 12 as well as over the U-shaped profile 32 of the infeed funnel 22. The screws 36, 38 and the screw connections 42, 44 provide a fastening of the infeed funnel 22 or the guide rail 12 to the connecting element.

FIG. 2 also shows sliding profiles 58. Rail leg slide profiles 60, 62 are attached to the inside of the rail legs 18, 20.

In addition, funnel element slide profiles 64, 66 are arranged on the inner surfaces 28, 30 of the funnel elements 24, 26.

Preferably, the slide profiles 50 are made of plastic.

The rail leg sliding profiles 60, 62 protrude from the guide rail 12 in the upper region thereof or are extended. As a result, as shown in FIG. 1, in the assembled state of the guide rail 12 with the connecting element, the rail leg sliding profiles 60, 62 also cover the region of the legs 50, 52 of the connecting element.

Alternatively or additionally, the funnel element sliding profiles 64 66 may protrude or the connecting element may have separate sliding profiles 50.

Figure 3:
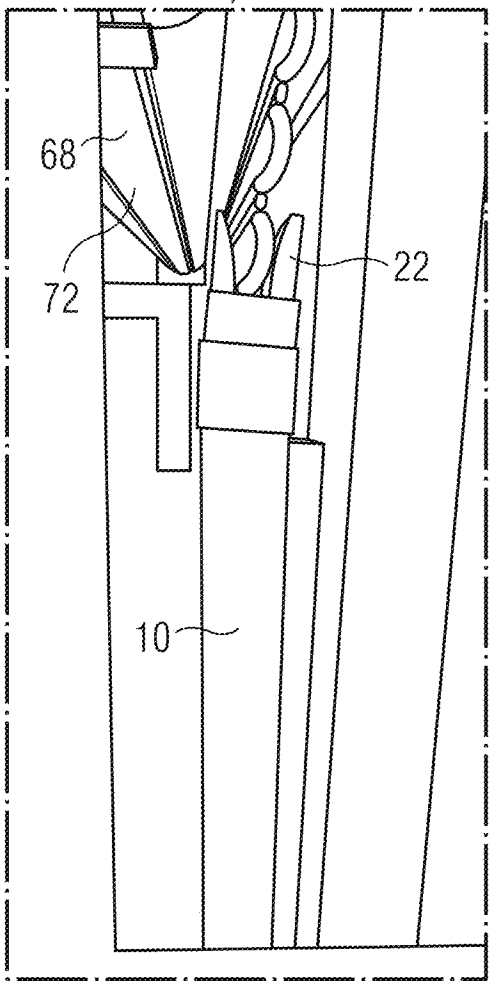
FIG. 3 a lateral view of the rolling door with the rolling door armor and the guide rail device in a mounted state and with the rolling door armor moved up (open state)

FIG. 3 shows the rolling door 11 with a guide rail device 10 from the side, wherein a rolling door armor 68 is wound on a winding shaft 70 concealed by the rolling door armor 68 in FIG. 3 and the rolling door 11 is in an open state.

The winding shaft 70 is usually located in the interior of a building opening to be closed with the rolling door 11, which corresponds to the left side of the illustration in FIG. 3. Accordingly, the right side represents the outer space of the rolling door 11.

As can be seen in FIG. 3, a bale 72 of the coiled rolling door armor 68 has a large diameter.

One end of the coiled rolling door armor 68 leads downwardly into the infeed funnel 22 of the guide rail device 10.

In this embodiment, there is a free area between the winding shaft 70 or the bale 72 and the guide rail device 68 in which no lateral guide is provided due to the varying diameter of the bale 72.

The rolling door armor 68 has a slightly negative feed angle relative to the guide rail 12 of the guide rail device 10.

Thus, the rolling door armor 68 does not hang exactly vertically downward because the guide rail 12 of the guide rail device 10 is not aligned tangentially to the bale 72.

Figure 4:
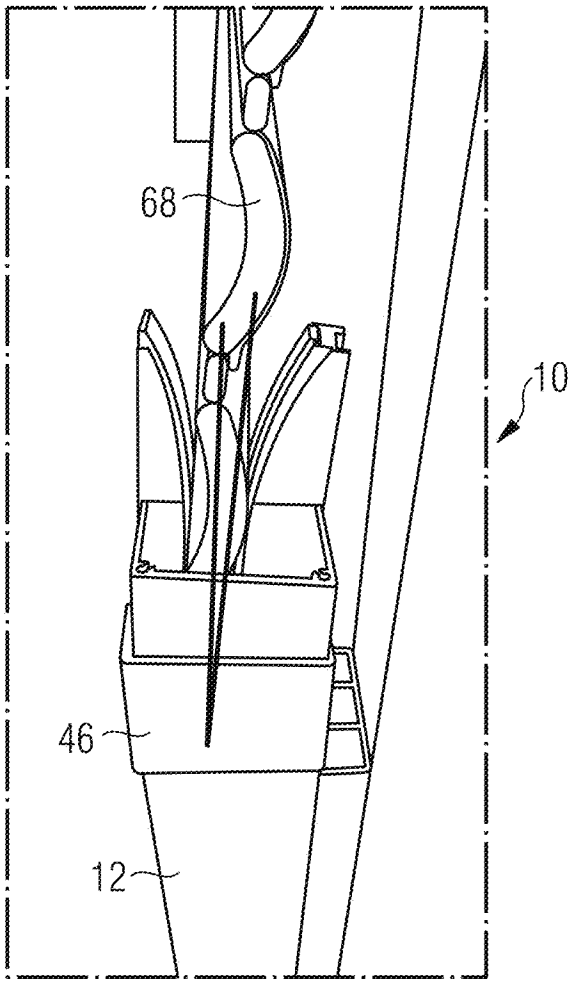
FIG. 4 an enlarged view of the guide rail device of FIG. 3.

This can also be seen in the enlarged view of the guide rail device 10 of FIG. 4. The lines drawn indicate the orientation of the vertical guide rail 12 and the rolling door armor 68, and include a slightly negative angle.

Since the connecting element is elastic, the connecting element is elastically bent as a result of the negative feed angle of the rolling door armor 68.

Accordingly, the infeed funnel 22 adjusts to the negative angle and inclines in the direction of the right side in FIG. 3 and FIG. 4, i.e., for example, in the direction of the outer space of a building opening to be closed.

Figure 5:
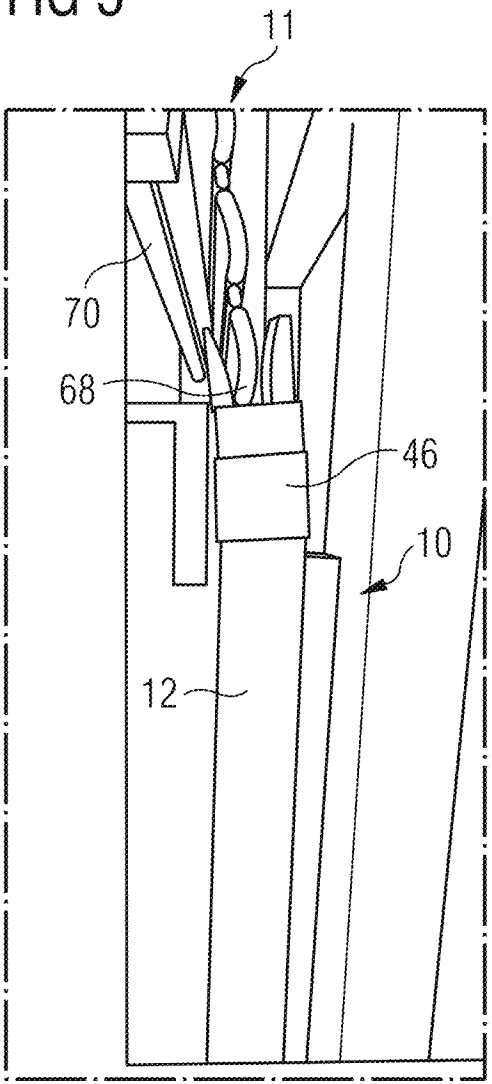
FIG. 5 a lateral view of the rolling door with the rolling door armor and the guide rail device in a mounted state and with the rolling door armor moved down (closed state)

FIG. 5 shows, in analogy to FIG. 3, a side view of the rolling door 11, with the rolling door armor 68 unwound from the winding shaft 70. Now the winding shaft 70 is also visible.

Accordingly, the bale 72 is now empty.

The end of the rolling door armor 68 now enters the guide device 10 at a positive feed angle relative to the guide rail 12, since the guide rail device 10 is not positioned exactly tangentially below the winding shaft 70.

The connecting element is elastically bent by the positive feed angle of the rolling door armor 68, here to the left side in FIG. 5.

Figure 6:
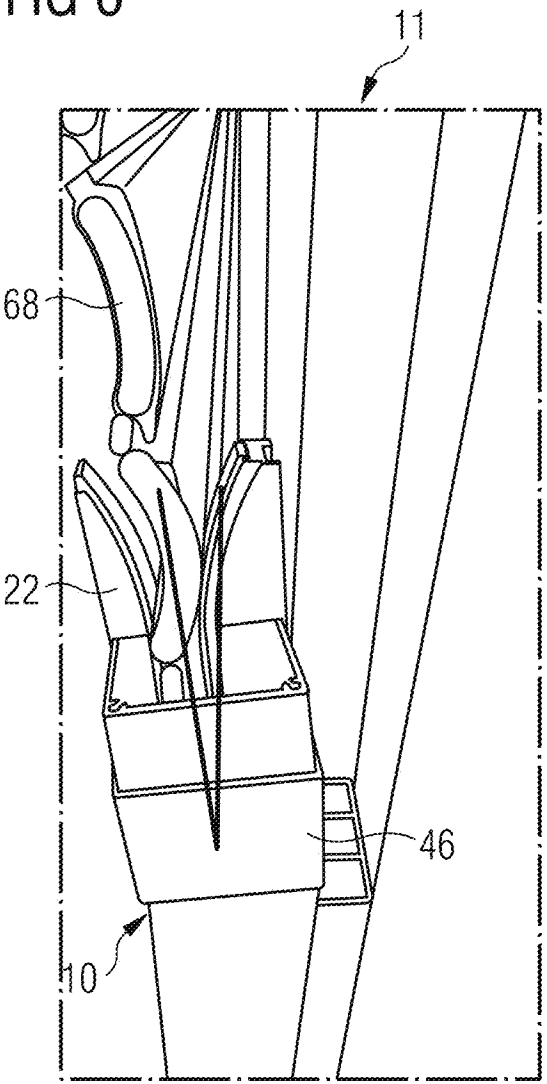
FIG. 6 an enlarged view of the guide rail device of FIG. 5.

Finally, FIG. 6 shows an enlarged view of the guide rail device 10 of FIG. 5. Again, the lines drawn indicate the orientation of the rolling door armor 68 relative to the vertical guide rail 12.

The infeed funnel 22 now adjusts to the positive angle and also leans to the left side in FIGS. 5 and 6.

When the rolling door 11 is moved, the infeed funnel 22 is movable.

The sliding profiles 58, i.e. the rail leg sliding profiles 60, 62 and the funnel element sliding profiles 64, 66, enable the rolling door armor 68 to slide along the guide rail device 10 with low friction.

During travel, the rolling door armor 68 passes the connecting element through the opening 54 and slides therein on the extended rail leg sliding profiles 60, 62.

The infeed funnel 22 always adjusts to the current infeed angle of the rolling door armor 68 relative to the guide rail 12 of the guide rail device 10 during travel of the rolling door armor 68.

The flexible infeed funnel 22 thus also adjusts to the acting forces and absorbs a part of the lateral acting forces of the rolling door armor 68.

This results in low-noise operation of the rolling door 11.

Furthermore, wear on the rolling door armor 68 and on the infeed funnel 22 or the funnel element slide profiles 64, 66 is reduced.

To dampen vibrations and shocks of the movable infeed funnel 22, the guide rail device 10 also has a damping body 46.

Thus, another advantage of the invention is that vibrations and shocks of the infeed funnel 22 are dampened by the damping body 46 connected to the infeed funnel 22 each time the rolling door armor 68 is deflected.

This dampens or prevents the transition of noise from the infeed funnel 22 to the guide rail 12.

In addition, the rolling door armor 68 is prevented from jolting during travel of the rolling door armor 68 in that region between the winding shaft 70 and the guide rail 10 attached to the building opening to be closed, where the rolling door armor 68 may move laterally due to the varying diameter of the bale 72 and the movable infeed funnel 22.

One embodiment of the invention has been described above with reference to rolling doors. For more detailed configurations of possible embodiments of such rolling doors and also of rolling grilles, reference is made to the company publication [1] referred to at the beginning.

The invention is particularly suitable for industrial doors.

LIST OF REFERENCE SIGNS

10 guide rail device
11 rolling door
12 guide rail
16 web of the U-shaped profile of the guide rail
18, 20 rail leg
22 infeed funnel
24, 26 funnel elements
28, 30 inner surfaces of funnel elements
32 U-shaped profile of infeed funnel
36, 38 screws
42, 44 screw connections
46 damping body
48 web of damping body
50, 52 leg of damping body
54 opening of damping body
56 relining tube
58 sliding profiles
60, 62 rail leg sliding profiles
64, 66 funnel element sliding profiles
68 rolling door armor
70 winding shaft
72 bale

The invention claimed is:

1. A guide rail device for laterally guiding a rolling door of a rolling door system or a rolling grille armor of a rolling grille system, the guide rail device comprising:

a guide rail for vertically guiding the rolling door or the rolling grille armor;

an infeed funnel disposed vertically above the guide rail for guiding the rolling door or the rolling grille armor into an entry area of the guide rail, the infeed funnel including two opposing funnel elements that are disposed on opposite sides with respect to the rolling door or the rolling grille armor and fixedly interconnected via a U-shaped profile, wherein the funnel elements and the U-shaped profile form a rigid structure of the infeed funnel; and a damping body disposed above the guide rail and below the infeed funnel and directly connected to both the guide rail and the infeed funnel, wherein the damping body is made of an elastomer to allow the rigid structure of the infeed funnel to be tilted as a whole with respect to the guide rail and to dampen vibrations and shocks of the infeed funnel.

2. The guide rail device according to claim 1, wherein the damping body is attached to the guide rail and to the infeed funnel via screwed connections.

3. The guide rail device according to claim 1, wherein the damping body is configured to be plug-fitted on the guide rail and the infeed funnel.

4. The guide rail device according to claim 1, wherein the guide rail is formed in an elongated U-shape having two opposite rail legs connected to each other via a web, and wherein a respective rail leg sliding profile is provided on inner sides of each rail leg for the rolling door or the rolling grille armor to slide along.

5. The guide rail device according to claim 4, wherein the funnel elements of the infeed funnel are inclined or curved away from a centerline of the rail legs of the guide rail.

6. The guide rail device according to claim 5, wherein each of the funnel elements comprises a funnel element sliding profile for sliding of the rolling door or the rolling grille armor.

7. The guide rail device according to claim 6, wherein the rail leg sliding profiles protrude above the guide rail, wherein the funnel element sliding profiles protrude above the infeed funnel, and wherein the rolling door or the rolling grille armor slides on and along the funnel element sliding profiles and then the rail leg sliding profiles when passing through the opening of the damping body.

8. The guide rail device according to claim 5, wherein the funnel elements are made of metal, plastic, or an elastomer or combinations thereof.

9. The guide rail device according to claim 1, wherein the damping body is formed in an elongated U-shape having a web, two opposite legs and an opening for the passage of the rolling door or rolling grille armor.

10. A door comprising a first guide rail device and a second guide rail device, wherein each of the first guide rail device and the second guide rail device comprises the guide rail device according to claim 1, and wherein the guide rail of the first guide rail device is fixed laterally on a building opening to be locked with the door, and the guide rail of the second guide rail device is fixed laterally on an opposite side of the building opening to be locked with the door.

* * * * *